United States Patent [19]

Farias et al.

[11] Patent Number: 4,644,256

[45] Date of Patent: Feb. 17, 1987

[54] SYSTEM DRIVEN BY SOLAR ENERGY FOR PUMPING LIQUIDS

[75] Inventors: Paulo D. Farias; Francisco A. F. Mazzei, both of Porto Alegre; Ubirajara do E. Santo, Sao Paulo; Paulo Werle, Porto Alegre, all of Brazil

[73] Assignee: Icotron S.A. Industria de Componentes Electronicos, Gravatai, Brazil

[21] Appl. No.: 514,187

[22] Filed: Jul. 15, 1983

[30] Foreign Application Priority Data

Jul. 16, 1982 [BR] Brazil ..... 8204205

[51] Int. Cl.[4] ..... G05F 5/00

[52] U.S. Cl. ..... 323/299; 323/906; 363/124; 320/1; 320/2

[58] Field of Search ..... 363/124, 128, 136; 323/906, 299-300; 320/1, 2, 39-40, 43, 60

[56] References Cited

U.S. PATENT DOCUMENTS 3,596,369 8/1971 Dickerson et al. ..... 363/128 x 4,134,057 1/1979 Portmann ..... 323/906 X 4,390,940 6/1983 Corbefin et al. ..... 323/906 X

FOREIGN PATENT DOCUMENTS 0118532 9/1979 Japan ..... 363/136

OTHER PUBLICATIONS

Franx, "A New Approach to Solar Pump Systems Using Submersible Motors", Commission of the European Communities, 2nd E.C. Photovoltaic Solar Energy Conference, Berlin, W. Germany (Apr. 23-26, 1979), pp. 1038-1046.

*Primary Examiner*—Peter S. Wong

*Attorney, Agent, or Firm*—Herbert L. Lerner; Laurence A. Greenberg

[57] ABSTRACT

A system converting solar energy into electric power for driving an electro-mechanical pump to pump liquid by processing electric power furnished by solar cells of variable level, which includes converting the solar energy into pulses of constant electric power, the pulses spaced from one another as a function of the level of solarization.

3 Claims, 2 Drawing Figures

SYSTEM DRIVEN BY SOLAR ENERGY FOR PUMPING LIQUIDS

The invention is related to a system driven by solar energy for pumping liquids and, more particularly, to a system of the type which transforms solar energy into electric power for use in driving an electro-mechanical pump, by processing electric power furnished by the solar cells of variable level.

It is an object of the invention to provide a system driven by solar energy for pumping liquids which is independent of fluctuations in levels of solarization which causes variations of electric power.

BACKGROUND OF THE INVENTION

The use of centrifugal pumps having a motor which is connected directly to the solar cells has become known heretofore; such pumps require a minimum rotation for operation thereof, to be able to maintain manometric pressure without which the pump does not pump. This minimum rotation of the driving motor requires a supply of a constant amount of electric power to be able to pump a liquid above the manometric pressure of the system. During periods of low level of solarization, the operation of the motor-centrifugal pump unit must be assured, making it necessary to resort to a great many solar cells. In driving centrifugal pumps, a d-c motor is used which, when connected to the solar cells, present the disadvantage of not permitting the transfer of the entire electric energy available in the solar cells outside the insulation peaks. This happens because the electric d-c motor has an apparent resistance proportional to the speed of rotation thereof, and when the electrical energy furnished by the solar cells is not maximum (periods of low level of solarization), the speed of the motor will be lower, therefore presenting also a lower apparent resistance which is in series with the internal resistance of the solar cells, causing the generated electric power to be partially dissipated in the solar cells with consequent decrease in yield of the system. Also known heretofore is the use of chemical accumulators of electrical energy, which store the energy generated by the solar cells, the accumulators driving an electro-mechanical system for pumping liquids.

Because of the technical drawbacks set forth, the high costs of the low-yield systems in use, the liquid pumping systems employing solar energy are restricted to low manometric pressures, the task of the invention of the instant application being to offer a better technical solution without the stated disadvantage, a better yeild and greater economy.

SUMMARY OF THE INVENTION

It is the purpose of the patent application to make the pumping of a liquid independent of the level of solarization by processing the electrica energy furnished by the solar cells so as to generate pulses of constant electric energy spaced in time as a function of the level of solarization, and when each pulse reaches the end of its period, the counterelectromotive force deriving from interruption of the pulse of constant energy will be reutilized, the energy being reutilized in the formation of the next pulse of constant electric energy, thereby increasing the yield of the system.

In a preferred application of the invention, and without eliminating other possible applications, uses an electro-mechanical pump of the diaphragm type which, when it receives a pulse of constant electric energy, moves it diaphragm pushing to one side the liquid contained in its discharge pipe and at the same absorbing the same quantity of liquid through the inlet pipe.

Other features which are considered as characteristic for the invention are set forth in the appended claims.

Although the invention is illustrated and described herein as embodied in system driven by solar energy for pumping liquids, it is nevertheless not intended to be limited to the details shown, since various modifications and structural changed may be made therein without departing from the spirit of the invention and within the scope and range of equivalents of the claims.

BRIEF DESCRIPTION OF THE DRAWING

The construction and method of operation of the invention, however, together with additional objects and advantages thereof will be best understood from the following description of specific embodiments when read in connection with the accompanying drawings, in which.

DESCRIPTION OF THE PREFERRED EMBODIMENT

Figure 1:
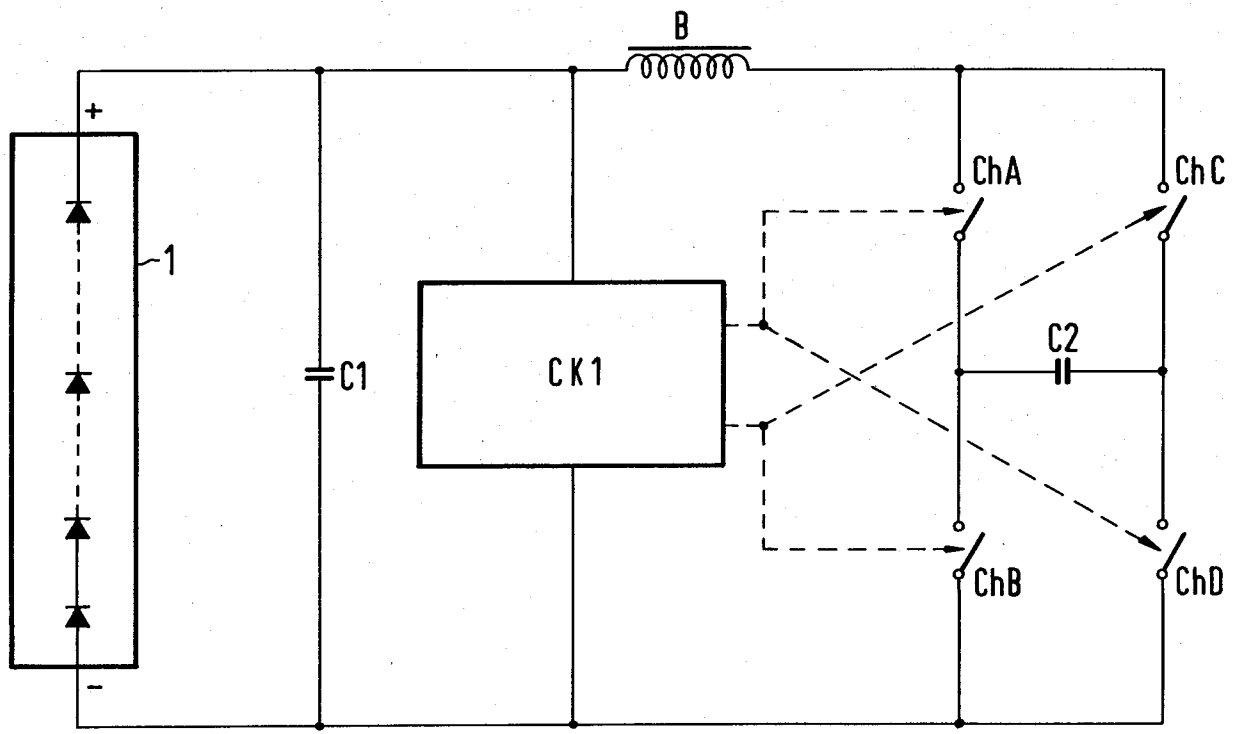
FIG. 1 is a block diagram of the system driven by solar energy for pumping liquids in accordance with the invention.

Referring now to the drawing and first, particularly, to FIG. 1 thereof, there are shwon capacitors C1 and C2, switches CHA and CHD, as well as seitches CHC and CHB, a coil B of an electro-mechanical pump, and a control circuit CK1.

In operation, the capacitor C1 is charged by the current supplied by solar cells; when it attains a predetermined potential, the control circuit CK1 activates the switches CHA and CHD, on the one hand, or CHC and CHB, on the other hand, closing them, the respective pairs of switches forming a series connection with the capacitor C2 and the coil B of the electro-mechanical pump. In the course of operation, the capacitor C1 discharges across the coil B of the electro-mechanical pump and charges the capacitor C2, the charge on the capacitor C1 consequenctly becoming reduced.

The coil B of the electro-mechanical pump is an induction coil, and by means of the pulse of constant electric energy supplied by the capacitor C1, a counter-electromotive force is generated inside the induction coil B. Consequently, after interruption i.e. termination, of the constant energy pulse, the capacitor C2 is recharged to a potential of contrary polarity to that existing before the start of the pulse.

The capacitor C2 holds the charge resulting from the re-utilization until the capacitor C1 has again been recharged, and the control circuit CK1 then actuates the next pulse when the respective pair of switches CHC and CHB or CHA and CHD are closed.

A new work cycle can be started when the capacitor C1 has reached its pre-established charge. The capacitor C1 is rated so that only a small part of its charge is transferred to the pulse which activates the winding B of the electro-mechanical pump; the voltage supplied by the cells to the load circuit remaining virtually stable, within the ideal value of impedance matching. The control circuit CK1 governs the connection of the respective switch pairs CHA and CHD or CHC and CHB for the formation of the pulses which are transferred to the electro-mechanical pump, in that the circuit CK1 monitors the charging voltage of the capacitor C1 and, when it reaches the predetermined value, it alternately actuates the respective pairs or switches CHA and CHD or CHC and CHB, depending upon the polarity of the capacitor.

Figure 2:
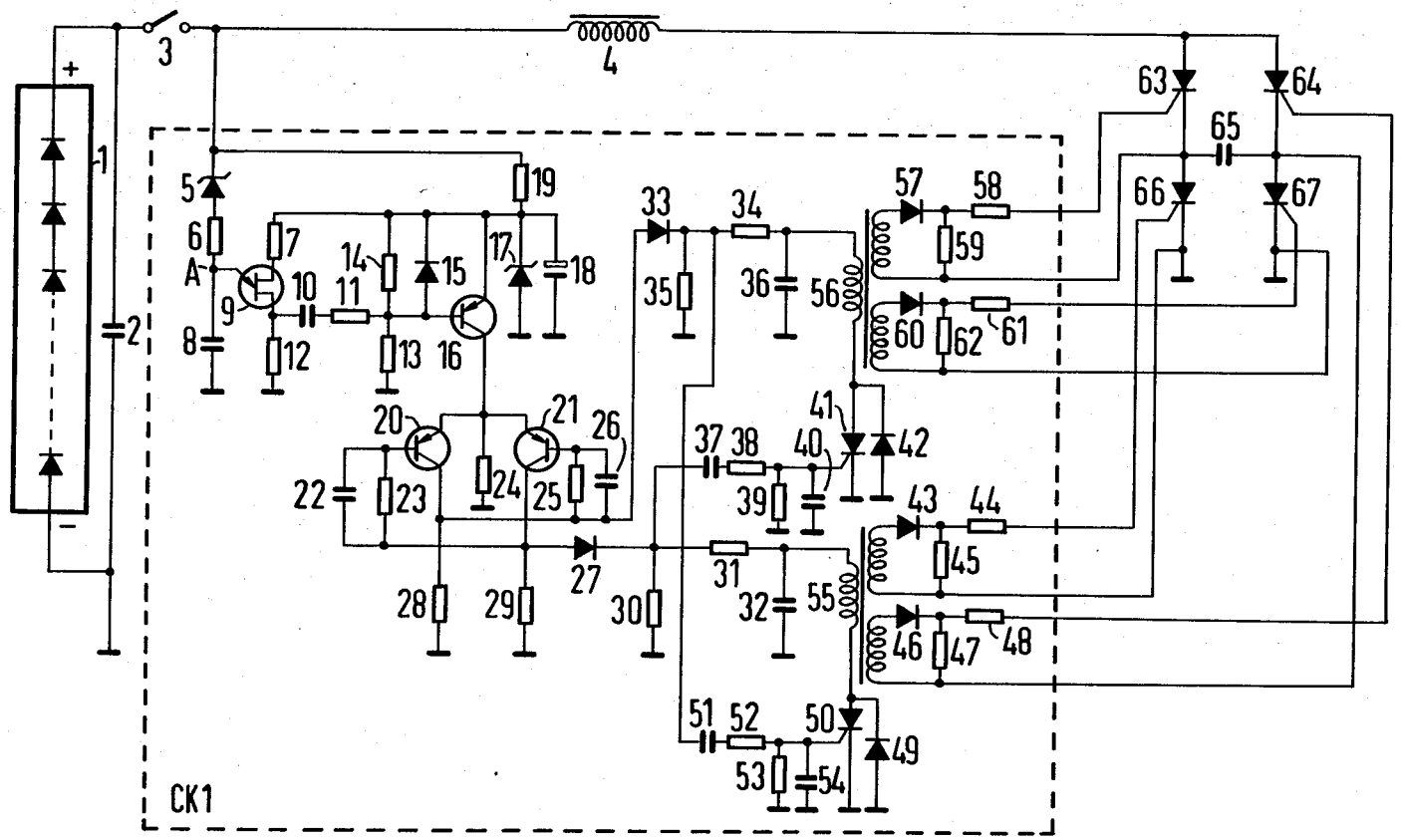
FIG. 2 is the circuit diagram of a preferred embodiment of the invention.

The complete circuit of FIG. 2, it can be seen that the pairs of switches CHA and CHD, on the one hand, and CHC and CHB, on the other hand, have been replaced, respectively, by thyristors 63 and 67, on the one hand, and 64 and 66, on the other hand.

The operation of the circuit of FIG. 2 is as follows: The circuit having been set in operation by closing a switch 3, a unijunction-type transistor 9 compares the voltage of capacitor 2, through a Zener diode 5 and an ohmic resistance 6 connected to the emitter of the transistor 9, with the voltage of the power source formed by an ohmic resistance 19, a Zener diode 17 and a filter capacitor 18; a pre-established charge of the capacitor 2 being given by the voltage at a point A plus the voltage of the Zener diode 5 of reference.

When the voltage of the emitter of the transistor 9 reaches the firing point, a capacitor 8 is discharged through this emitter via an ohmic resistor 12, generating a pulse which, via a capacitor 10 and a resistor 11, drives a transistor 16, pulling it out of saturation and causing it to cut off.

As current supplied to the emitters of transistor 20 and 21 decreases to zero, the capacitors 22 and 25 which were without charge are now caused to become charged, connecting the transistor which was cut off which, in its turn, cuts off the transistor which was connected. Every time the transistor 20 or 21 is saturated, it charges a respective capacitor 32 or 36 via a respective ohmic resistor 31 or 34, and a respective diode 27 or 33 also sends a pulse to the firing electrode of a respective thryristor 50 or 41 via a respective capacitor 51 or 37 and a respective ohmic resistor 52 or 38.

At that part of the circuit, there is also a respective resistor 53 or 39 and a respective capacitor 54 and 40 which serve the purpose of diminishing the possility of accidental firings of the respective thyristor. A diode 42 or 49, respectively, prevents the occurence of reverse voltages is the auxiliary thyristor 41 or 50, respectively. Firing of the respective thyristor 41 or 50 generates a current which is transferred to the firing electrodes of main thyristors 63 and 67, on the one hand, or 64 and 66, on the other hand, which drive the electro-mechanical pump 4.

Transfer for the firing current takes place through a respective pulse transformer 55 or 56 which forms, in the primary thereof, a circuit oscillating withthe respective load capacitor 32 or 36, and generating a current pulse in the form of a sinusoidal half-cycle.

The purpose of a pair of diodes 43 and 46, on the one hand, or 57 and 60, on the other hand, in the secondary of the respective pulse transformer 55 or 56 is to prevent the appearance of negative voltages in the firing electrode of the main thyristors. The ohmic resistors 44 and 48, on the one hand, or 58 and 61, on the other hand, equalizes the currents which are transferred to the secondaries of the pulse transformer 55 or 56, preventing an imbalance in those currents due to a voltage drop difference in the firing electrodes of the thyristors.

The resistors 45 and 47, on the one hand, or 59 and 62, on the other hand, reduce the impedence of the firing electrodes of the thyristors 63 and 67, on the one hand, or 64 and 66, on the other hand, for the purpose of increasing immunity thereof to accidental firing.

There are claimed:

1. Process for converting solar energy into electric power for driving an electro-mechanical pump to pump liquid by processing electric power furnished by solar cell exposed to a variable level of solarization, which comprises converting the solar energy into succeeding pulses of constant electric power, the pulses being spaced from one another as a function of the level of solarization.

2. Process according to claim 1, which includes re-utilizing a counterelectromotive force resulting from interruption of each pulse at the end of its period for forming a next succeeding pulse.

3. System for performing a process of converting solar energy into electric power for driving an electro-mechanical pump to pump liquid, comprising a first condenser connected to and charge by solar cells to a given potential, two pairs of switch elements, a second condenser having a given polarity and a control circuit, by which, depending upon said given potential of said first condenser and said polarity of said second condenser, the second condenser is alternately connected in series with a coil of the electro-mechanical pump via a respective pair of said switch elements.

* * * * *